US005784807A

United States Patent [19]

Pagel

[11] Patent Number: 5,784,807

[45] Date of Patent: Jul. 28, 1998

[54] FLUID FILLED SUPPORT SYSTEM FOR FOOTWEAR

[76] Inventor: Todd A. Pagel, 802 N. 5th Ave., Wausau, Wis. 54401

[21] Appl. No.: 715,244

[22] Filed: Sep. 18, 1996

Related U.S. Application Data

[60] Provisional application No. 60/003,887 Sep. 18, 1995.

[51] Int. Cl.[6] ..... A43B 13/18; A43B 13/38; A43B 7/14; A47C 16/00

[52] U.S. Cl. ..... 36/93; 36/28; 36/29; 36/43; 36/153; 5/655.3; 5/707

[58] Field of Search ..... 36/28, 29, 35 R, 36/35 B, 37, 43, 44, 3 B, 54, 141, 153, 93, 88, 55; 2/239, DIG. 3; 5/707, 706, 711, 655.3, 655.5

[56] References Cited

U.S. PATENT DOCUMENTS

| | | |
|---|---|---|
| 3,685,176 | 8/1972 | Rudy . |
| 3,854,228 | 12/1974 | Conroy . |
| 3,914,881 | 10/1975 | Strigel . |
| 3,925,916 | 12/1975 | Garbuio . |
| 4,038,762 | 8/1977 | Swan, Jr. . |
| 4,100,686 | 7/1978 | Sgarlato et al. . |
| 4,128,951 | 12/1978 | Tansill . |
| 4,217,705 | 8/1980 | Donzis . |
| 4,229,889 | 10/1980 | Petrosky . |
| 4,243,754 | 1/1981 | Swan, Jr. . |
| 4,255,202 | 3/1981 | Swan, Jr. . |
| 4,266,298 | 5/1981 | Graziano . |
| 4,471,538 | 9/1984 | Pomeranz et al. . |
| 4,662,087 | 5/1987 | Beuch . |
| 4,744,157 | 5/1988 | Dubner . |
| 4,768,295 | 9/1988 | Ito . |
| 4,995,173 | 2/1991 | Spier . |
| 5,101,580 | 4/1992 | Lyden . |
| 5,134,790 | 8/1992 | Woitschaetzke et al. . |
| 5,155,927 | 10/1992 | Bates et al. . |
| 5,158,767 | 10/1992 | Cohen et al. . |
| 5,203,793 | 4/1993 | Lyden . |
| 5,257,470 | 11/1993 | Auger et al. . |
| 5,313,717 | 5/1994 | Allen et al. . |
| 5,325,614 | 7/1994 | Rosen . |
| 5,343,638 | 9/1994 | Legassie et al. . |
| 5,392,534 | 2/1995 | Grim . |

*Primary Examiner*—Paul T. Sewell
*Assistant Examiner*—Anthony Stashick
*Attorney, Agent, or Firm*—Sixbey, Friedman, Leedom & Ferguson; Jeffrey L. Costellia

[57] ABSTRACT

A fluid filled support system for footwear having a closed system of interconnected pods filled with fluid for providing enhanced cushioning, support, and fit. The fluid filled support system includes a support member which completely surrounds a wearer's foot to provide cushioning and support to the wearer's entire foot. A plurality of fluid-containing pods are positioned within the support member spaced apart from one another and at least partially filled with a fluid for absorbing shocks encountered by the footwear. A plurality of fluid communication channels are positioned between the fluidcontaining pods for interconnecting the pods and maintaining all of the pods in fluid communication with one another. Each fluid-containing pod includes at least three fluid communication channels extending from the pod to attach the pod to at least three adjacent fluid-containing pods. The fluid communication channels may intersect with one another to provide additional fluid pathways for connecting additional fluid-containing pods to each pod. As pressure is applied by a wearer's foot, the support member reacts by forcing the entrapped fluid to redistribute through the interconnected pods. Once the area of high pressure is relieved, the shoe again reaches a level of equilibrium. This flow of redistributing fluid between interconnected pods provides the desired cushioning and support of the wearer's foot, wherein the multiple fluid paths connected to each pod provide a more responsive cushioning system.

18 Claims, 5 Drawing Sheets

FLUID FILLED SUPPORT SYSTEM FOR FOOTWEAR

This application claims the benefit of U.S. Provisional Application Ser. No. 60/003,887 filed on Sep. 18, 1995.

BACKGROUND OF THE INVENTION

Technical Field

The present invention relates generally to a fluid filled support system for footwear that provides a custom fit to the wearer's foot while also providing cushioning, support, and stability to the wearer's foot. More particularly, the present invention is directed to a fluid filled support system for footwear having a plurality of fluid-containing bladders which are fluidically interconnected.

Background Art

Various methods and devices have been developed and used to improve support and cushioning in shoes to absorb the shock of footstep impact in walking, running and other activities. This is particularly true in athletic footwear where the foot is exposed to repeated shocks from heavy footstep impact. In many shoe soles designed to increase the cushioning effects of the sole, the increased resiliency of the shoe sole provides little resistance to the tendency of the shoe wearer's foot to rotate relative to the leg upon footstep impact. In providing additional cushioning to the shoe sole, these shoes sacrifice or reduce the support and stability provided to the foot by the shoe sole and increase the possibility for injury.

Some of the cushioning devices developed include pump devices which communicate with outside air to fill compartments provided in the shoe. Generally, such prior attempts at providing pneumatic cushioning of the foot have involved a single fluid receiving bladder, tubular in shape, which was supposed to provide cushioned support to the entirety of the wearer's foot. Although providing some measure of cushioned support, such tubular bladders have a number of problems. Firstly, with shoes containing a single fluid receiving cavity the wearer must become accustomed to a rock and sway motion, since with any weight shift while wearing such equipped shoes the wearer will rock side-to-side and sway front-to-back as the fluid is continually displaced. Further, problems encountered were in deflation, replacement, and the size and weight of the shoes necessary to contain such bladders.

In an effort to overcome the problems associated with a single fluid containing bladder, U.S. Pat. No. 3,685,176 issued to Rudy developed a inflatable cushioning for footwear having a plurality of intercommunicating flexible tubes. The inflatable tubes are to be positioned around the sides of the person's foot and formed to be disposed in a boot for embracing a person's foot, wherein the tubes are inflated to assist in resisting movement between the person's foot and the boot while providing added comfort. The inflatable bladder disclosed by Rudy, however, fails to provide inflatable tubes along the base or sole of the foot to provide cushioning from shocks encountered by the footstep impact. Therefore, there is still a need for a cushioned shoe which does not alter the structural integrity of the sole or heel portions thereof nor add any significant weight which would have to be lifted by the wearer.

Other attempts at providing cushioning have included shoe soles employing fluid filled pads or bladders to provide cushioning to the foot. U.S. Pat. No. 4,768,295 issued to Ito discloses one such sole having fluid filled pads. The sole is formed with a plurality of chambers which are filled with a gel to inflate them and the chambers are subsequently individually sealed. Such individually sealed chambers, however, tend not to provide the requisite cushioning when large shocks are encountered by the foot, because the fluidfilled chambers will only compress to a certain point. Once the fluid-filled chambers are fully compressed they no longer provide any additional cushioning effect. Therefore, other shoe soles have been developed, such as U.S. Pat. No. 5,313,717 issued to Allen et al., which incorporate a plurality of fluid-filled bladders into a shoe sole where the fluid-filled bladders are connected in fluid communication by fluid conducting channels. Allen et al. teach positioning fluid-filled bladders in the forefoot, arch, and/or heel areas of the shoe sole and providing fluid conducting channels between adjacent fluid-filled bladders contained in each area of the foot.

The problem with such strategically positioned bladders is that the particular fluid filled bladders employed are often incapable of providing cushioning to the foot for all of the varying magnitudes of force exerted on the foot and in all of the varying areas of the foot subjected to the forces in footstep impacts in all athletic activities. By providing cushioning in the particular area where the bladder is located, for example in the heel or forefoot areas of the shoe sole, these devices provide no cushioning for other areas of the shoe sole. Further, in cushioning soles having fluid conducting channels between adjacent fluid-filled bladders currently being used, such as the sole disclosed by Allen et al., when the fluid has been forced from one of the bladders to another bladder, these bladders are incapable of providing any cushioning of the force of an immediately occurring subsequent force, particularly in a difficult area of the foot.

In all of the foregoing prior art cushioning soles utilizing fluid filled bladders, there is a large amount of pressure exerted on the inner surface of the fluid filled bladder as the bladder is compressed by a force applied on the cushioning sole. These forces are often great enough to rupture or damage the bladder allowing the fluid to escape from the bladder and detrimentally affecting the cushioning characteristics of the sole. Therefore, there is a need for a fluid filled cushioning device for footwear which reduces the amount of force exerted on the inner surface of the fluid filled bladders.

In view of the foregoing, there is clearly a need for a fluid filled support system for a shoe which provides cushioning for the entire area of the foot without experiencing the above-described disadvantages of current cushioning devices. Furthermore, there is a need for a fluid filled support system for a shoe having multiple fluid filled chambers having an improved fluidic communication between the fluid filled chambers.

SUMMARY OF THE INVENTION

It is a primary object of the present invention to overcome the aforementioned shortcomings associated with the prior art.

Another object of the present invention is to provide a fluid filled support system for footwear exhibiting enhanced cushioning, support and fit which completely supports a wearer's foot.

A further object of the present invention is to provide a fluid filled support system for footwear which completely encases the wearer's foot to provide cushioning and support to the wearer's entire foot.

Yet another object of the present invention is to provide a fluid filled support system for footwear including a plurality of individual pods having increased fluidic communication between each fluid filled pod.

It is yet another object of the present invention to provide a fluid filled support system for footwear wherein each fluid filled pod is in fluidic communication with at least three other fluid filled pods.

A further object of the present invention is to provide a fluid filled support system for footwear which completely encases the wearer's foot to provide cushioning and support to the wearer's entire foot.

Yet a further object of the present invention is to provide a fluid filled support system for footwear having criss-crossing communication channels to enhance fluid communication between fluid containing pods.

It is another object of the present invention to provide a fluid filled support system for footwear which continues to maintain adequate support and cushion around a pressure point applied on the footwear by providing a delayed response between fluid containing pods.

It is still a further object of the present invention to provide a fluid filled support system for footwear which significantly reduces the force exerted on the fluid containing pods by distributing this force over each of the plurality of individual pods.

Another object of the present invention is to provide a fluid filled support system for footwear wherein the force against the inner walls of the fluid containing pods, particularly at the entrance of each of the fluid communication channels, is minimized due to this distribution of force over a large number of pods and channels.

These as well as additional objects and advantages of the present invention are achieved by providing a fluid filled support system for footwear having a closed system of interconnected pods filled with fluid for providing cushioning from encountered shocks. The fluid filled support system includes a support member of a shape generally suited to cushion a foot or selected portions of a foot, wherein the support member may completely encase a wearer's foot to provide cushioning and support to the wearer's entire foot. A plurality of fluid-containing pods are positioned within the support member spaced apart from one another and at least partially filled with a fluid for absorbing shocks encountered by the footwear. A plurality of fluid communication channels are positioned between the fluid-containing pods for interconnecting the pods and maintaining all of the pods in constant fluid communication with one another.

Each fluid-containing pod includes at least three fluid communication channels extending from the pod to attach the pod to at least three adjacent fluid-containing pods. The fluid communication channels may intersect with one another to provide additional fluid pathways for directly connecting additional fluid-containing pods to each pod. The plurality of fluid-containing pods and fluid communication channels form a closed system of interconnected pods filled with a non-toxic, low freezing point fluid or, alternatively, a gaseous fluid such as air. Each pod is preferably only partially filled with fluid, so that as pressure is applied by a wearer's foot, the support member reacts by forcing the entrapped fluid to redistribute through the interconnected pods. Once the area of high pressure is relieved, the shoe again reaches a level of equilibrium. This flow of redistributing fluid between interconnected pods provides the desired cushioning and support of the wearer's foot, wherein the multiple fluid paths connected to each pod provide a more responsive cushioning system.

These as well as additional advantages of the present invention will become apparent from the following description of the invention with reference to the several figures.

DETAILED DESCRIPTION OF THE PREFERRED EMBODIMENT

Figure 1:
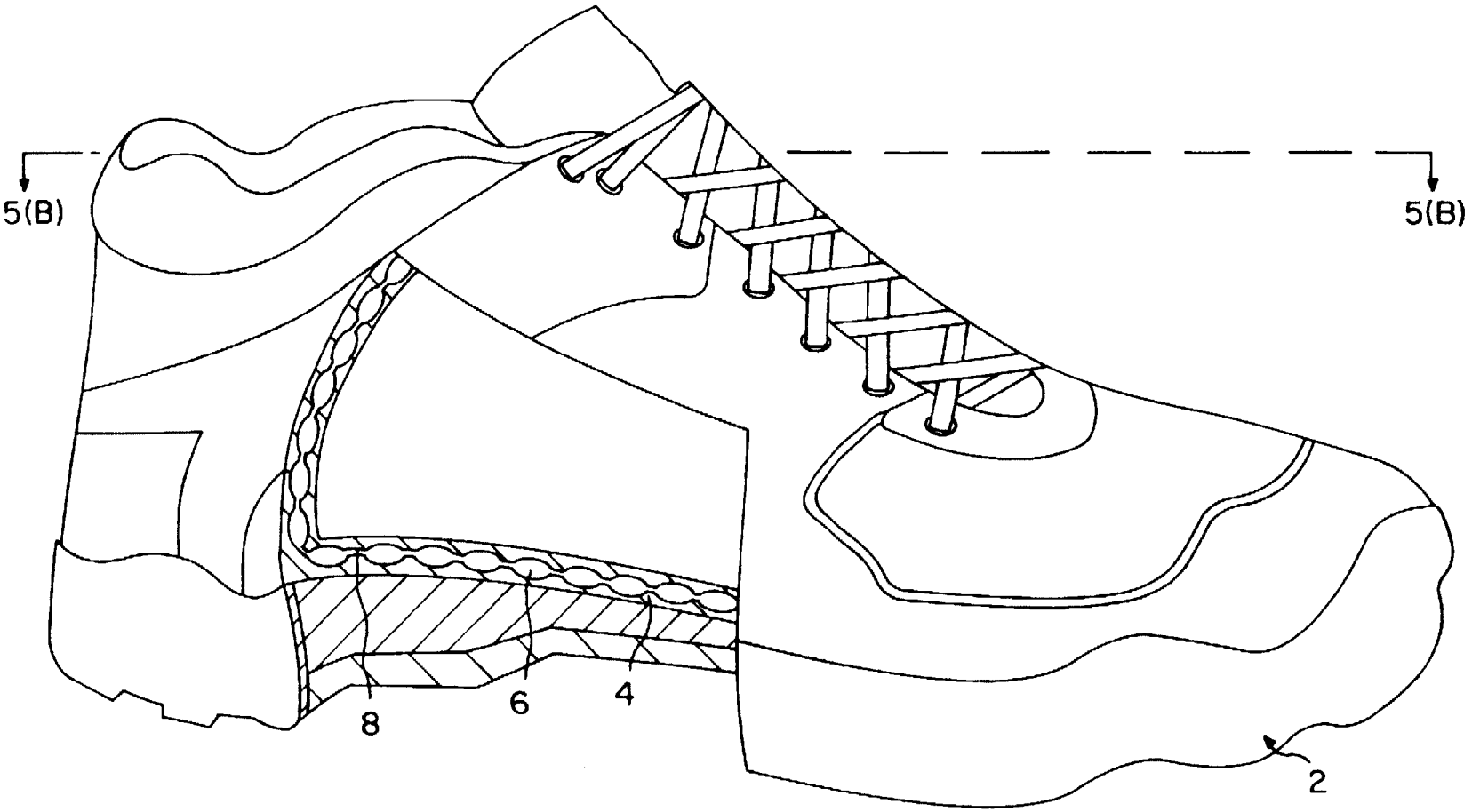
FIG. 1 is a cut-away perspective view of an athletic shoe including the support member of the present invention.

Referring now to FIG. 1, a perspective view of an athletic shoe 2 is illustrated having a section of the shoe 2 cut-away to show the support member 4 of the present invention positioned within the shoe 2. The support member 4 of the present invention includes a plurality of bladders or pods 6 spaced apart from one another within the support member 4, wherein the pods are all in fluid communication with each other in all areas of the shoe 2. The support member 4 itself, however, is sealed to the outside so that the pods 6 are self-contained within the support member 4. The pods 6 may be formed of varying sizes and shapes, while, in the preferred embodiment of the present invention, a majority of the pods 6 are less than ¼" in diameter. Preferably, all of the pods 6 are formed of substantially the same size and shape; however, it is understood that the pods 6 may be of any desired size and shape.

Although the support member 4 of the present invention is primarily described in connection with an athletic shoe 2, it is further understood by those skilled in the art that the description is merely illustrative, and the support member 4 of the present invention is equally adaptable to various other types of shoes. Alternatively, the support member 4 may be formed separately from a shoe so that it is interchangeable between a plurality of shoes worn by the user.

Figure 6:
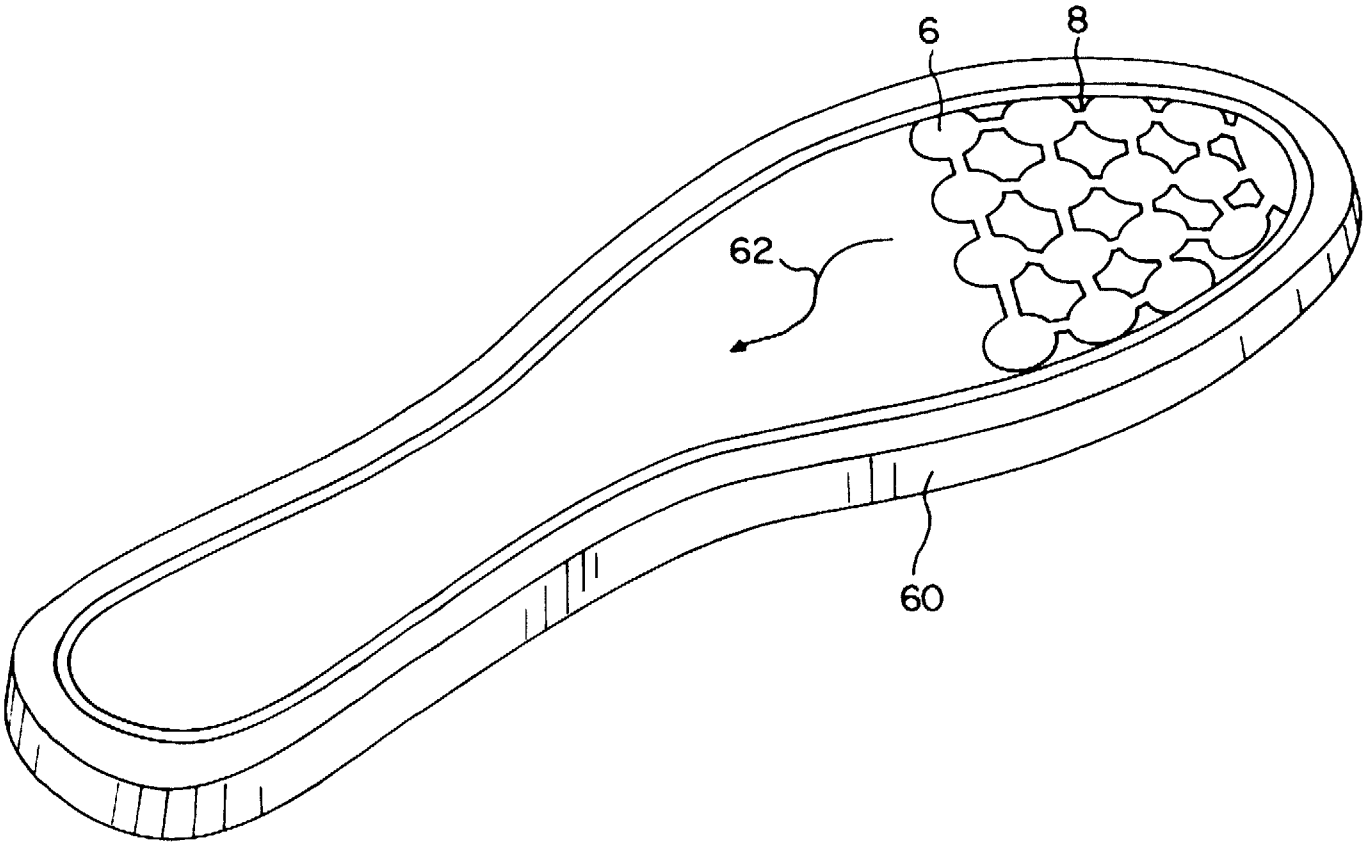
FIG. 6 is a perspective view of another embodiment of the support member of the present invention including a plurality of pods in fluid communication with one another through communication channels which are not criss-crossing in the sole of a shoe.

Each of the plurality of pods 6 is maintained in fluid communication with each of the other pods 6 within the support member 4 through fluid communication channels 8. Each pod 6 includes a plurality of separate channels 8 or tunnels which branch off from the pod 6 in different directions to adjacent pods 6. As indicated by the arrows 10 in FIG. 2, the fluid contained within the pods 6 may flow in either direction through the fluid communication channels 8.

wherein the length and diameter of the fluid communication channels 8 can be varied to achieve different flow characteristics between the pods depending upon the desired cushioning effect to be provided by the fluid filled support system. In the preferred embodiment of the present invention, each pod 6 includes four separate channels 8 extending therefrom. These fluid communication channels 8 each connect to adjacent pods 6 which similarly include three additional channels extending therefrom to other adjacent pods 6, as shown in FIG. 6.

Figure 3:
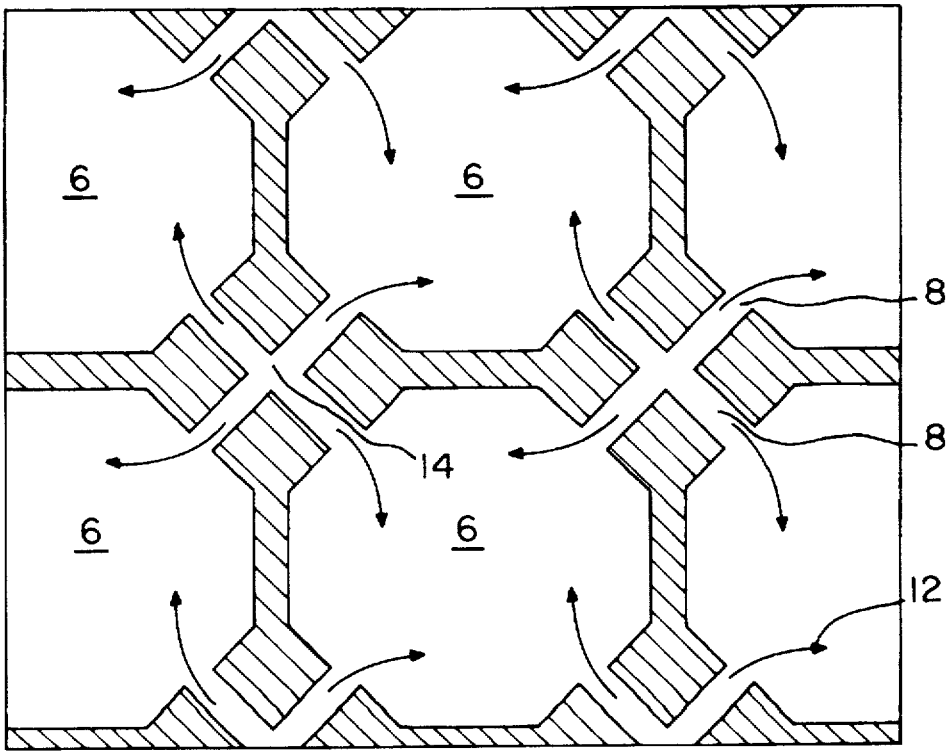
FIG. 3 is a top view of one embodiment of the support member of the present invention including a plurality of pods in fluid communication with one another through criss-crossing communication channels to enhance fluid communication.

The fluid communication channels 8 may also be in fluid communication with another fluid communication channel 8 extending from an adjacent pod 8. Specifically, in an alternative embodiment of the present invention, two fluid communication channels 8 may cross each other at a point 14 as they extend between two pods 6 in a criss-cross manner, as show in FIG. 3. Preferably, the fluid communication channels 8 intersect one another at a 90° angle; however, it is understood that the support member 4 may be formed such that the fluid communication channels 8 intersect with each other at any angle. Such a construction permits a single pod having four fluid communication channels 8 extending therefrom to be in fluid communication with eight adjacent pods 6, rather than merely four (4). The arrows 12 in FIG. 3 indicate the different direction from which fluid may enter into each pod 6. By providing an increased number of pathways through which fluid may enter into and exit from a pod 6, a more efficient response can be achieved by the fluid filled support system by delaying the redistribution of fluid to adjacent pods 6 when fluid is forced from one pod 6, as will be described in detail hereinafter. Such an efficient response provides improved cushioning and support, and also provides a rapid return to equilibrium to account for subsequently occurring forces exerted on the wearer's foot. In yet another embodiment of the present invention, the fluid communication channels 8 may cross one another but not intersect with another fluid communication channel 8.

Figure 4A:
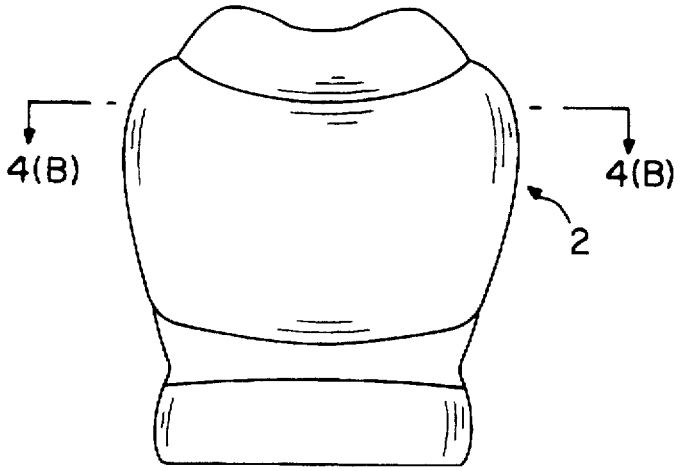
FIG. 4(A) is a back view of an athletic shoe in accordance with one embodiment of the present invention.
Figure 4B:
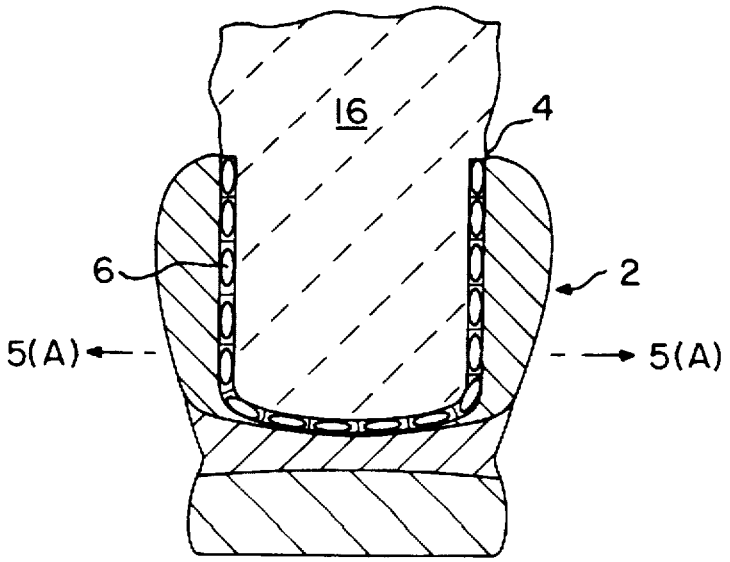
FIG. 4(B) is a sectional back view of the athletic shoe of FIG. 4(A) including the support member of the present invention supporting a wearer's foot.
Figure 5A:
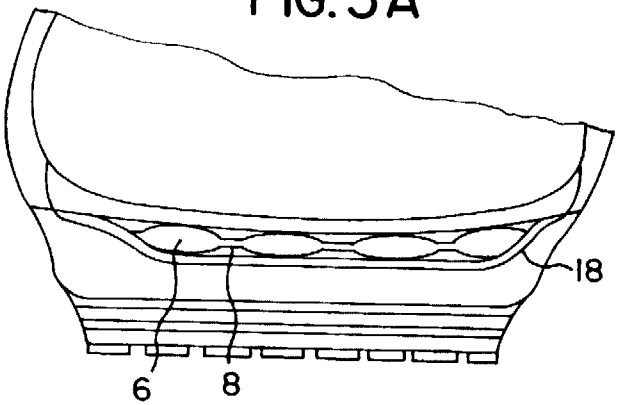
FIGS. 5(A) and 5(B) are a fragmentary sectional back view and a partially-sectional side view, respectively, of a preferred embodiment of the present invention showing the support member of the present invention incorporated in the sole, tongue, and side walls of a shoe.
Figure 5B:
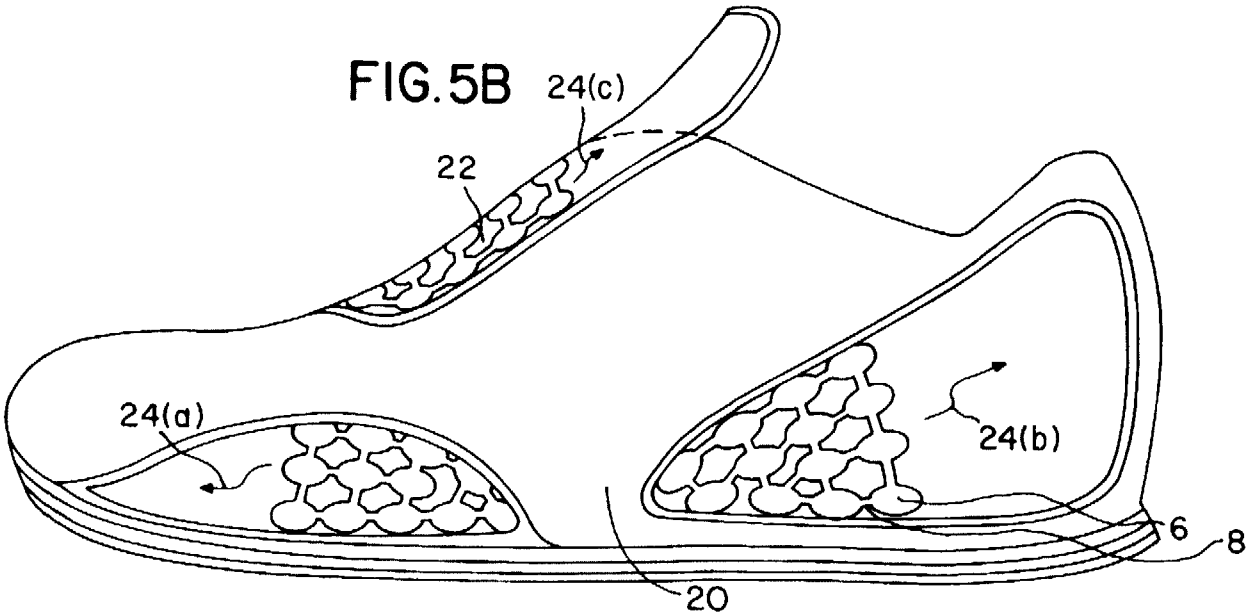

In the preferred embodiment of the present invention, the pods 6 and interconnected channels 8 of the support member 4 surround the entire foot of the wearer. Thus, when the support member 4 is incorporated within a shoe 2 as shown in FIG. 4(A), the support member 4 will surround the portion of the foot 16 positioned within the shoe 2, as shown in FIG. 4(B). The support member 4 extends around the inner periphery of the shoe 2 so that the configuration of interconnected pods 6 also surround the entire foot of the wearer. The support member 4 runs the entire length of the shoe 2 to include the sole, sides, heel and forefoot of the wearer, as well as the tongue portion of the shoe. FIGS. 5(A) and 5(B) illustrate partial cut-away views of the shoe 2 to show the configuration of pods 6 and fluid communication channels 8 extending through the sole 18, sides 20 and tongue 22 of the shoe 2. While FIG. 5(B) only illustrates the pods 6 extending over a portion of the shoe 2, the pods 6 continue to extend around the entire shoe 2 in the directions of arrows 24*a*, 24*b*, and 24*c* so as to encase the entire portion of the foot 16 positioning within shoe 2. In view of the large number of individual pods 6 each in fluid communication with each other substantially encasing the entire foot, a wearer's foot can be more adequately supported.

The support member 4 may be shaped to enclose the entire foot 16 of the wearer in a sock-like manner where all sections of the sock are in fluid communication with each other. Alternatively, the support member 4 may be divided up into individual areas or zones. These areas may include, for example, the sole, heal, side panels and tongue. In this alternative embodiment of separate areas, each area includes the plurality of the fluid communicating pods 6, as described above. FIG. 6 illustrates the configuration of pods 6 and fluid communication channels 8 within a separate sole portion 60 of the support member. Again, while the pods 6 are shown on only a portion of the sole portion 60, in actuality the pods 6 extend the entire length of sole area 60 in the direction of arrow 62. Each of these areas may be formed separate from the other, and, thus, not in fluid communication. For instance, all of the pods 6 within sole portion 60 are maintained in fluid communication and all of the pods within side panels of the support member 4 are in fluid communication; however, in this embodiment, the pods 6 within side panels would not be in fluid communication with the pods 6 in sole portion 60. Alternatively, the different areas may be formed in fluid communication with one or more of the other areas, depending upon the desired cushioning and supporting characteristics to be provided.

The support member 4 should be constructed from a flexible, fluid-tight barrier material which is capable of being bonded to the inner periphery of a shoe 2. Preferably, the material is a plastic-type material, such as polyurethane or other similar material. The support member 4 may be constructed from overlapping layers of a flexible, fluid and air tight barrier material, which may be two solid layers sealed at the peripheral edge thereof. The plurality of individual pods 6 and corresponding fluid communication channels 8 are formed in the body of the support member 4. The layers can be bonded together by any convention bonding techniques. Alternatively, each individual pod 6 may be constructed of the barrier material and connected to each adjacent pod by the addition of the respective fluid communication channels 8 by further sealing the two solid layers together at these locations. Further, the support member 4 could also be formed as a single unit using a molding process, such as injection molding.

Figure 2:
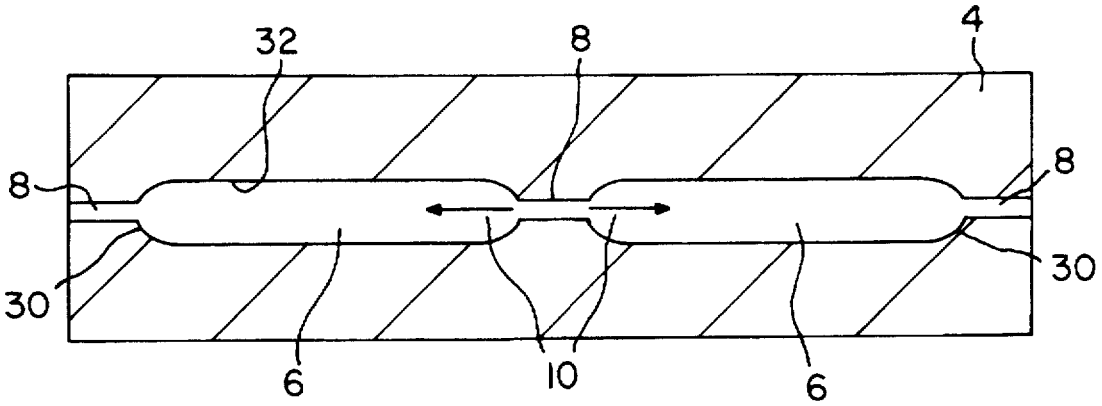
FIG. 2 is an enlarged, sectional side view of the interconnected pods of the present invention including the fluid communicating channel therebetween.

The fluid material provided within the support member 4 for travel between adjacent pods 6 may be a liquid or gel having a low freezing point, or, alternatively, a gaseous fluid such as air. The material may also be a combination of liquid materials and may include solid objects distributed therein. By selecting a liquid material having a certain viscosity, the type of support provided by the support member 4 of the present invention can be changed depending upon the user's needs and the type of shoe 2 in which the support member 4 is used. The size and diameter of the fluid communication channels can also be sized to regulate the volume and speed of fluid flow between each individual pod 6 to further control the cushioning and support characteristics of the support member. Referring now to FIG. 2, in this embodiment of the present invention, the entrance 30 into each pod 6 from its respective fluid communication channels 8 are tapered or conically shaped to facilitate fluid flow from one pod 6 to another without exerting too much force against the walls 32 of the pod 6 near the entrance 30. This reduces the possibility of rupturing the walls 32 of a pod 6, particularly during strenuous activity where large amounts of pressure can be exerted on a pod 6 from the force applied by the foot on the support member 4. Therefore, utilizing a tapered entrance 30 assists in retaining the structural integrity of the individual pods 6 over extended periods of use.

The fluid filled support member 4 functions by redistributing the fluid material between pods 6 in response to pressures applied on the support member 4. When pressure is applied to specific areas of the support member 4 by the user's foot 16, the force is distributed equally to areas of less pressure as the liquid material moves through the interlocking fluid communication channels 8 from pod 6 to pod 6.

The pods 6 in close proximity to the pressure point will become compressed and tend to force the entrapped fluid within the pods 6 to adjacent pods 6 experiencing less pressure. Each pod 6 is preferably only partially filled with fluid to allow additional fluid to travel into the pod 6 during the redistribution of fluid. As the stress is relieved from the pressure point, the support member 4 adjusts to again reach an equilibrium point. By providing a plurality of small individual pods 6 each including a plurality of fluid communication channels 8, the applied pressure does not immediately force the liquid material from one area of the shoe 2 to another. In other words, each pod 6 surrounding the pressure point will release the liquid material held therein at slightly different times depending upon its proximity to the pressure point. The fluid in those pods 6 experiencing the most pressure will be forced out first, while the fluid in the pods 6 surrounding the pressure point will be released more slowly depending upon the distance from the center of the pressure point. As a result, the pods 6 surrounding the pressure point continue to maintain adequate support and cushion. Without such a delayed response, the support member 4 would not provide sufficient cushioning at the point of pressure. Moreover, by providing a large number of individual pods 6, cushioning of the foot is enhanced during use since each of the cooperating pods 6 reacts in a slightly different manner as a result of its position with respect to the pressure point.

Further, the forces exerted by the user's foot on each of the pods 6 and the corresponding fluid communication channels 8 are significantly reduced by distributing this force evenly over each of the plurality of individual pods 6. Additionally, the force against the inner walls of the pods 6, particularly at the entrance of each of the fluid communication channels 8, is minimized due to this distribution of force over a large number of pods 6 and channels 8.

The fluid filled support system formed in accordance with the present invention will provide customized footwear exhibiting enhanced cushioning, support, and fit. While the support member of the present invention has been described above incorporated into a shoe, it is understood that the support member for completely supporting a user's foot does not need to be integral component of a shoe but may be formed separately.

What is claimed is:

1. A fluid cushioning and supporting apparatus for an article of footwear, comprising:

a support member of a shape to cushion a foot, said support member surrounding a substantial portion of the foot including an upper portion of the foot;

a plurality of fluid-containing pods spaced apart from one another formed throughout said support member for absorbing shocks encountered by the footwear; and a plurality of fluid communication channels positioned between said fluid-containing pods for traversely interconnecting said fluid-containing pods and maintaining said fluid-containing pods in fluid communication;

wherein said plurality of fluid-containing pods includes a first set of fluid-containing pods having two fluid communication channels attached thereto for directly connecting each of said first set of fluid-containing pods to two adjacent fluid-containing pods;

a second set of fluid-containing pods having three fluid communication channels attached thereto for directly connecting each of said second set of fluid-containing pods to three adjacent fluid-containing pods; and a third set of fluid-containing pods having four fluid communication channels attached thereto for directly connecting each of said third set of fluid-containing pods to four adjacent fluid-containing pods and wherein at least one of said plurality of fluid communication channels extending between a first pair of fluid-containing pods transversely intersects another of said fluid communication channels extending between a second pair of fluid-containing pods wherein said second pair of fluid-containing pods is different from said first pair of fluid-containing pods.

2. The fluid cushioning and supporting apparatus for an article of footwear as defined in claim 1, wherein each of said fluid communication channels intersects with at least one other of said fluid communication channels.

3. The fluid cushioning and supporting apparatus for an article of footwear as defined in claim 1, wherein support member is integrally formed within a shoe.

4. The fluid cushioning and supporting apparatus for an article of footwear as defined in claim 3, wherein said fluid-containing pods extend an entire length of said shoe, including the sole, sides, heel, forefoot, and tongue portions of the said shoe.

5. The fluid cushioning and supporting apparatus for an article of footwear as defined in claim 1, wherein said fluid contained within said fluidcontaining pods is a liquid.

6. The fluid cushioning and supporting apparatus for an article of footwear as defined in claim 1, wherein said fluid contained within said fluidcontaining pods is a gas.

7. The fluid cushioning and supporting apparatus for an article of footwear as defined in claim 1, wherein the size and diameter of said fluid communication channels are varied to regulate the volume and speed of fluid flow between said fluid-containing pods.

8. The fluid cushioning and supporting apparatus for an article of footwear as defined in claim 1, wherein each of said fluid-containing pods are substantially filled with fluid when said fluid cushioning and supporting apparatus is in an equilibrium state.

9. A fluid cushioning and supporting apparatus for an article of footwear, comprising:

a support member shaped to cushion a foot;

a plurality of fluid-containing pods spaced apart from one another formed throughout said member for absorbing shocks encountered by the footwear, wherein said fluid-containing pods extend around substantially the entire periphery of said foot;

a plurality of fluid communication channels including at least first fluid communication channels positioned between first pairs of said plurality of fluid-containing pods and second fluid communication channels positioned between second pairs of said plurality of fluid-containing pods, said second pairs being different from said first pairs;

wherein at least one of said first fluid communication channels transversely intersects in fluid communication with one of said second fluid communication channels to interconnect in fluid communication at least one of said first pairs of said plurality of fluid-containing pods and at least one of said second pairs of said plurality of fluid-containing pods.

10. The fluid cushioning and supporting apparatus for an article of footwear sa defined in claim 9, wherein at least one of said fluid-containing pods has four first fluid communication channels extending therefrom directly connecting to at least four adjacent fluid-containing pods to form four first pairs.

11. The fluid cushioning and supporting apparatus for an article of footwear as defined in claim 10, wherein said four first fluid communication channels transversely intersects four second fluid communication channels, such that said at least one of said plurality of fluid-containing pods is interconnected to eight adjacent fluid-containing pods.

12. The fluid cushioning and supporting apparatus for an article of footwear as defined in claim 9, wherein said support member is constructed from a flexible, fluid-tight barrier material which is capable of being bonded to the material of a shoe.

13. The fluid cushioning and supporting apparatus for an article of footwear as defined in claim 9, wherein support member is integrally formed within a shoe.

14. The fluid cushioning and supporting apparatus for an article of footwear as defined in claim 13, wherein said fluid-containing pods extend the entire length of said shoe, including the sole, sides, heel, forefoot, and tongue portions of the said shoe.

15. The fluid cushioning and supporting apparatus for an article of footwear as defined in claim 9, wherein said fluid contained within said fluidcontaining pods is a liquid.

16. The fluid cushioning and supporting apparatus for an article of footwear as defined in claim 9, wherein said fluid contained within said fluidcontaining pods is a gas.

17. The fluid cushioning and supporting apparatus for an article of footwear as defined in claim 9, wherein the size and diameter of said fluid communication channels are varied to regulate the volume and speed of fluid flow between said fluid-containing pods.

18. The fluid cushioning and supporting apparatus for an article of footwear as defined in claim 9, wherein each of said fluid-containing pods are substantially filled with fluid when said fluid cushioning and supporting apparatus is in an equilibrium state.

* * * * *